US008684227B2

(12) United States Patent
Richardson et al.

(10) Patent No.: US 8,684,227 B2
(45) Date of Patent: Apr. 1, 2014

(54) MERCHANDISE DISPLAY HOOK INCLUDING HELICAL TIME DELAY MECHANISM HAVING BI-DIRECTIONAL GEAR

(75) Inventors: Justin A. Richardson, Waxhaw, NC (US); David N. Berglund, Marvin, NC (US); Larry K. Hooks, Fort Mill, SC (US); Gregory C. Schultz, Huntersville, NC (US)

(73) Assignee: InVue Security Products Inc., Charlotte, NC (US)

( * ) Notice: Subject to any disclaimer, the term of this patent is extended or adjusted under 35 U.S.C. 154(b) by 180 days.

(21) Appl. No.: 12/957,527

(22) Filed: Dec. 1, 2010

(65) Prior Publication Data

US 2011/0127225 A1 Jun. 2, 2011

Related U.S. Application Data

(60) Provisional application No. 61/265,604, filed on Dec. 1, 2009.

(51) Int. Cl.

| | |
|---|---|
| ***B65H 3/00*** | (2006.01) |
| *G07F 11/24* | (2006.01) |
| *E05B 73/00* | (2006.01) |
| *B42F 17/02* | (2006.01) |
| *E05B 65/00* | (2006.01) |
| *E05B 19/26* | (2006.01) |

(52) U.S. Cl.

USPC ..... 221/251; 221/277; 211/7; 211/51; 70/57.1; 70/413

(58) Field of Classification Search

USPC ..... 211/4, 7, 59.1–59.3, 57.1; 248/551, 248/225.21, 224.8, 304, 303; 221/251, 277, 221/279; 70/14, 57.1, 62, 276, 413

See application file for complete search history.

(56) References Cited

U.S. PATENT DOCUMENTS

| | | | | |
|---|---|---|---|---|
| 3,400,857 | A * | 9/1968 | Schubert | 221/93 |
| 4,308,974 | A * | 1/1982 | Jones | 221/196 |
| 4,600,119 | A * | 7/1986 | Olson | 221/75 |
| 4,638,922 | A * | 1/1987 | Stoltz | 221/75 |
| 6,464,089 | B1 * | 10/2002 | Rankin, VI | 211/59.3 |
| 6,659,291 | B2 * | 12/2003 | Huehner et al. | 211/4 |
| 6,957,555 | B1 * | 10/2005 | Nagel et al. | 70/57.1 |
| 7,197,902 | B1 * | 4/2007 | Barkdoll | 70/57.1 |
| 7,392,673 | B2 * | 7/2008 | Fawcett et al. | 70/14 |
| 7,533,784 | B2 * | 5/2009 | Vlastakis et al. | 221/258 |

(Continued)

*Primary Examiner* — Joshua J Michener
*Assistant Examiner* — Devin Barnett
(74) *Attorney, Agent, or Firm* — InVue Security Products Inc.

(57) ABSTRACT

A merchandise display hook for displaying items of merchandise includes a support rod and a helix disposed about the support rod and extending along at least a lengthwise portion of the support rod. The support rod includes mounting structure for mounting the display hook to a display fixture and has a first end adjacent the mounting structure and a second end opposite the first end adjacent the helix for loading the items of merchandise onto the support rod and for dispensing the items of merchandise from the support rod. The merchandise display hook further includes a time delay mechanism attached to the helix adjacent the second end of the support rod so as to define a space therebetween for loading and dispensing the items of merchandise. The time delay mechanism includes a gear assembly configured for permitting the items of merchandise to be loaded onto the support rod at a rate that is faster than the rate at which the items of merchandise can be dispensed from the support rod.

17 Claims, 7 Drawing Sheets

(56) References Cited

U.S. PATENT DOCUMENTS

| | | | | |
|---|---|---|---|---|
| 7,559,437 | B2 * | 7/2009 | Colelli et al. | 221/312 A |
| 2003/0029816 | A1 * | 2/2003 | Huehner et al. | 211/7 |
| 2004/0084386 | A1 * | 5/2004 | Huehner et al. | 211/4 |
| 2005/0029283 | A1 * | 2/2005 | Pedigo | 221/289 |
| 2006/0157431 | A1 * | 7/2006 | Nagelski et al. | 211/54.1 |
| 2007/0283615 | A1 * | 12/2007 | Vlastakis et al. | 43/55 |
| 2008/0169250 | A1 * | 7/2008 | Nagelski | 211/7 |
| 2008/0209960 | A1 * | 9/2008 | Nagelski | 70/57.1 |
| 2009/0057244 | A1 * | 3/2009 | Conti et al. | 211/7 |
| 2009/0095695 | A1 * | 4/2009 | Moock et al. | 211/57.1 |
| 2010/0206825 | A1 * | 8/2010 | Johnston et al. | 211/59.2 |
| 2010/0223965 | A1 * | 9/2010 | Richardson et al. | 70/58 |
| 2010/0280655 | A1 * | 11/2010 | Wilson et al. | 700/231 |
| 2011/0036789 | A1 * | 2/2011 | Richardson et al. | 211/1.57 |
| 2012/0097622 | A1 * | 4/2012 | Surma et al. | 211/7 |

* cited by examiner

MERCHANDISE DISPLAY HOOK INCLUDING HELICAL TIME DELAY MECHANISM HAVING BI-DIRECTIONAL GEAR

CROSS REFERENCE TO RELATED APPLICATION

This non-provisional application claims the benefit of U.S. Provisional Application No. 61/265,604, filed Dec. 1, 2009, the entire disclosure of which is incorporated herein by reference.

FIELD OF THE INVENTION

The invention relates generally to a merchandise display hook for displaying items of merchandise on a display fixture. More particularly, the invention is a merchandise display hook including a helical time delay mechanism having a bi-directional gear for increasing the amount of time required to remove an item of merchandise from the display hook, while still permitting rapid loading of items of merchandise onto the display hook.

BACKGROUND AND RELATED ART

Merchandise display hooks are utilized extensively to display items of merchandise, for example, in a retail store. Typically, a plurality of display hooks are each individually mounted on a generally vertical display fixture, such as a conventional slat wall or slot wall, wire grid, bar rack or pegboard. The use of multiple display hooks on the display fixture provides an aesthetic and organized display area that allows potential purchasers to view the items of merchandise without assistance from sales personnel. Typically, the items of merchandise are retained within transparent packaging or within a transparent secure container, referred to or "keeper," that is configured to be suspended from a display arm, wire or rod (collectively referred to herein as the "support rod") of the display hook. In many instances, the value of the items of merchandise warrants the use of a display hook having one or more anti-theft features. It is known to provide the support rod of a merchandise display hook that supports "high risk" merchandise with a series of S-bends adjacent the free end of the support rod to prevent a shoplifter from "sweeping" all of the items off the display hook. It is also known to provide a mechanical time delay mechanism adjacent the free end of the support rod to increase the amount of time required to dispense each item of merchandise from the display hook. It is also known to provide the display hook with a locking device configured to be positioned on the support rod between the free end and at least one of the items of merchandise. The S-bend and time delay mechanism types of anti-sweep theft protection do not require the assistance of sales personnel to dispense items of merchandise from the support rod, while an anti-sweep locking device requires a special key and assistance from sales personnel to dispense an item of merchandise that is supported on the support rod between the locking device and the display fixture.

Anti-sweep features such as S-bends, time delay mechanisms and locking devices are generally effective at reducing or preventing sweeping. Accordingly, determined shoplifters have resorted to forcibly removing the entire display hook along with the items of merchandise from the display fixture. Typically, the display hook must be rotated, tilted or angled upwardly sufficiently to disengage the mounting structure of the display hook from the display fixture. In a particular example, the display hook includes a pair of mounting pegs, referred to herein as "antlers," that are inserted through apertures formed in the display fixture. The display hook is commonly known as a "peg hook" and the display fixture is commonly known as "pegboard." The antlers engage the rear surface of the pegboard, while another mounting feature of the peg hook engages the front surface to mount the peg hook on the pegboard. As a result, it is intentionally time consuming to remove the peg hook from the pegboard, especially with the presence of other display hooks nearby. Despite the significant time and difficulty required to remove a peg hook from a pegboard display fixture, an appreciable number of retailers have found it desirable to utilize a peg hook including a locking base. The locking base prevents the peg hook from being rotated, tilled or angled sufficiently to disengage the antlers from the apertures of the pegboard, thereby preventing the display hook from being forcibly removed from the display fixture along with the items of merchandise.

The combination of an anti-sweep feature and a locking base provides a comprehensive theft prevention system for a merchandise display hook. The S-bend type of anti-sweep theft protection is inexpensive, but is less effective than a time delay mechanism or a locking device since a skilled shoplifter can manipulate items of merchandise along the S-bend and off the free end of the support rod fairly quickly. Furthermore, the S-bend provides no audible or visible indication to sales personnel that a shoplifter is attempting to sweep items of merchandise off the support rod. A locking device is more effective than the S-bend and the time delay mechanism types of anti-sweep theft protection since items of merchandise between the locking device and the display fixture are secured (i.e. locked) onto the support rod. However, as previously mentioned, assistance from sales personnel is required to dispense those items of merchandise from the support rod. Accordingly, many retailers permit a small number of the items of merchandise to be displayed on the display hook between the locking device and the free end of the support rod. As a result, a time delay mechanism is typically the most cost effective and reliable type of anti-sweep theft protection for reducing or eliminating the theft of all of the items of merchandise displayed on a display hook.

Existing time delay mechanisms, however, include features or characteristics that may frustrate potential purchasers. One such time delay mechanism is shown and described in United States Patent Application Publication No. 2009/0095695 A1 published Apr. 16, 2009, and assigned to the assignee of the present invention. That time delay mechanism includes a pair of mechanically interlocked time delay arms medially disposed on the support rod. The time delay arms are sequentially movable to permit a purchaser to manipulate an item of merchandise past the time delay arms one at a time for removal from the display hook. However, it may be difficult for a potential purchaser with limited dexterity to successfully manipulate an item of merchandise off the support rod. Furthermore, the items of merchandise typically must be loaded onto the support rod individually (i.e., one at a time). In some instances, a small number of relatively thin items of merchandise can be loaded onto the support rod at the same time by increasing the distance between the adjustable time delay arms. However, the time delay mechanism is not configured to permit rapid loading of items of merchandise onto the support rod, sometimes referred to in the art as "fast stocking."

Another existing time delay mechanism is shown and described in U.S. Pat. No. 7,533,784 B2 issued May 19, 2009, and assigned to Rock-Tenn Shared Services, LLC of Norcross, Ga. That time delay mechanism includes a dispensing gate that allows a single item of merchandise to be dispensed from a support rod upon rotation of a knob to displace the dispensing gate relative to the merchandise. A timing motor produces a mechanical time-delay before the knob can be rotated again to dispense another item of merchandise. A stop, or lock, may also be provided to permit the dispensing gate to be retained in a position that allows bulk loading of the items of merchandise onto the support rod. The time delay mechanism, however, is fairly complex, costly to produce and subject to malfunction.

Yet another existing time delay mechanism is shown and described in U.S. Pat. No. 7,559,437 B2 issued Jul. 14, 2009, and assigned to Displays Plus, Inc. of Placentia, Calif. The time delay mechanism of the '437 patent is provided on a merchandise display hook commercially known as the "Spiral Anti-Sweep Hook" and available from FFR-DSI of Cleveland, Ohio. The Spiral Anti-Sweep Hook includes an elongate helical coil disposed about the support rod and affixed to a rotatable knob. When the knob, and consequently the helical coil, are rotated in a first direction (e.g. clockwise), the items of merchandise are individually dispensed from the support rod. The rate at which each item of merchandise is dispensed depends on the amount of time required to rotate the knob one full rotation (i.e., 360 degrees) since the knob and the helical coil are directly affixed to one another. Accordingly, it is possible to dispense items of merchandise from the support rod fairly quickly by rotating (i.e. spinning) the knob at a rapid rate. Furthermore, items of merchandise must be loaded onto the support rod one at a time by rotating the knob, and consequently the helical coil, in a second direction opposite the first direction (e.g., counter-clockwise). Accordingly, rapid loading of items of merchandise onto the display hook is not possible.

Accordingly, there exists a need for a merchandise display hook for displaying items of merchandise on a display fixture having an improved time delay mechanism for increasing the amount of time required to remove an item of merchandise from the display hook, while still permitting rapid loading of items of merchandise onto the support rod of the display hook. There exists a more particular need for a merchandise display hook including a time delay mechanism that permits a potential purchaser with limited dexterity to successfully manipulate an item of merchandise off the support rod of the display hook. There exists a further specific need for a merchandise display hook including a time delay mechanism that is not exceedingly complex, costly or subject to malfunction. There exists yet a further, more specific need for a merchandise display hook including a time delay mechanism that permits items of merchandise to be loaded onto the support rod of the display hook at a rate that is faster than the rate at which the items can be dispensed from the display hook.

DETAILED DESCRIPTION OF PREFERRED EMBODIMENTS OF THE INVENTION

Figure 1:
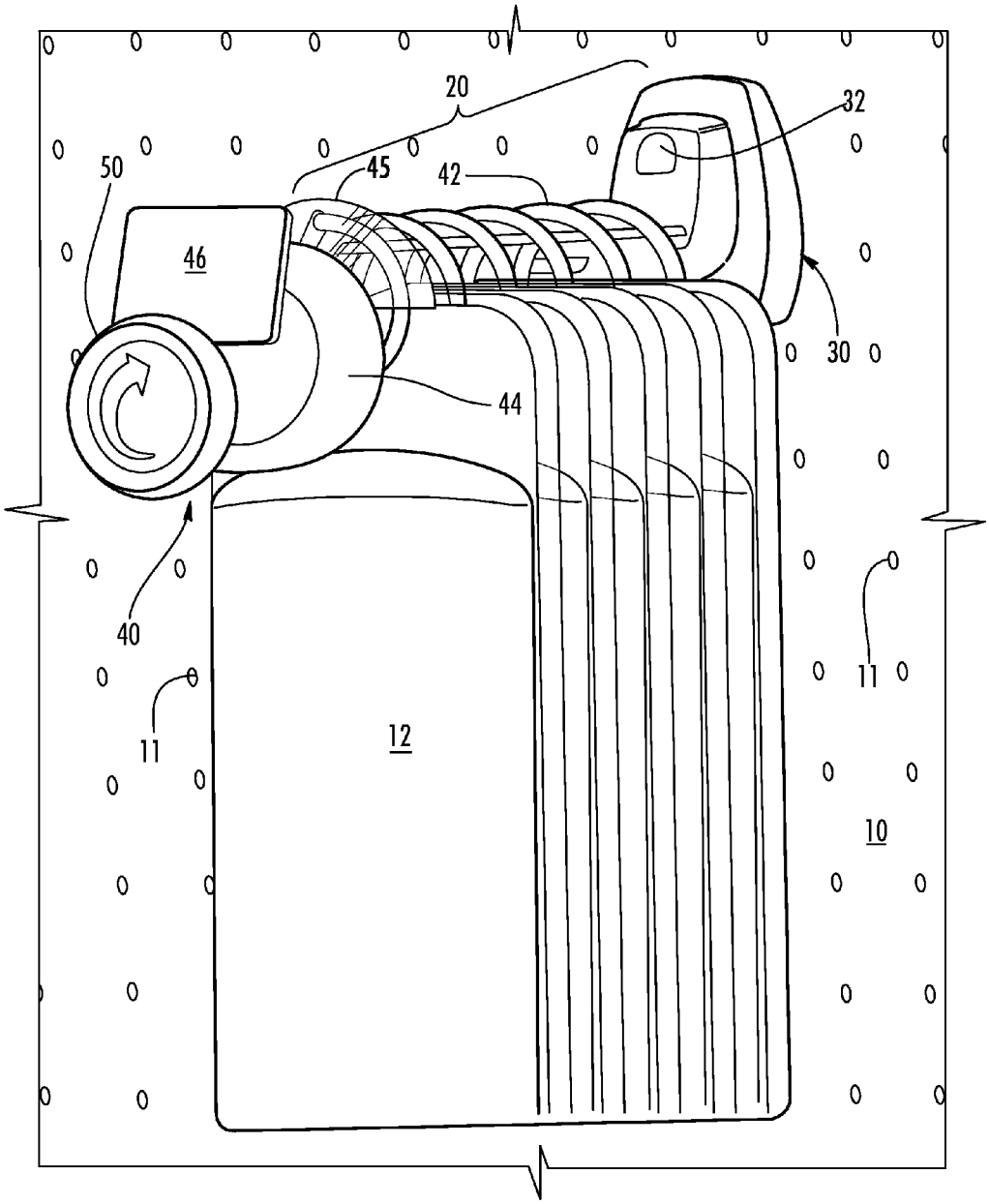
FIG. 1 is a right front perspective view of a merchandise display hook including a time delay mechanism constructed in accordance with the invention.

The accompany drawing figures illustrate one or more exemplary embodiments of a merchandise display hook, indicated generally at 20, for mounting on a display fixture 10, such as a pegboard, slat wall or slot wall, wire grid or bar rack. For convenience, the display fixture 10 shown herein is a conventional pegboard type display fixture commonly referred to as "pegboard." The display hook 20 comprises a time delay mechanism, indicated generally at 40, constructed in accordance with the invention. The time delay mechanism 40 is operable for increasing the amount of time required to remove an item of merchandise, indicated generally at 12, from the display hook 20, while still permitting rapid loading (commonly referred to as "stocking") of the items of merchandise onto the display hook for being displayed within a display area of a retail store. Each item of merchandise 12 is suspended from the display hook 20, or alternatively, is secured within a keeper (not shown) that is suspended from the display hook. As shown and described herein, the merchandise display hook 20 is a peg style display hook, also referred to as a "peg hook," suitable for mounting on the pegboard 10. Pegboard 10 is typically made of metal, plastic, cardboard or pressed board and has a plurality of regularly spaced apertures 11 formed therethrough for receiving mounting structure of the display hook 20, as will be described. Although a peg hook 20 is shown and described herein for purposes of illustration and explanation, it will be readily apparent to those skilled in the art that the broad concept of the invention is applicable to other types of merchandise display hooks configured with suitable mounting structure for mounting on a different type of display fixture, such as slat wall or slot wall, wire grid or bar rack.

Figure 3:
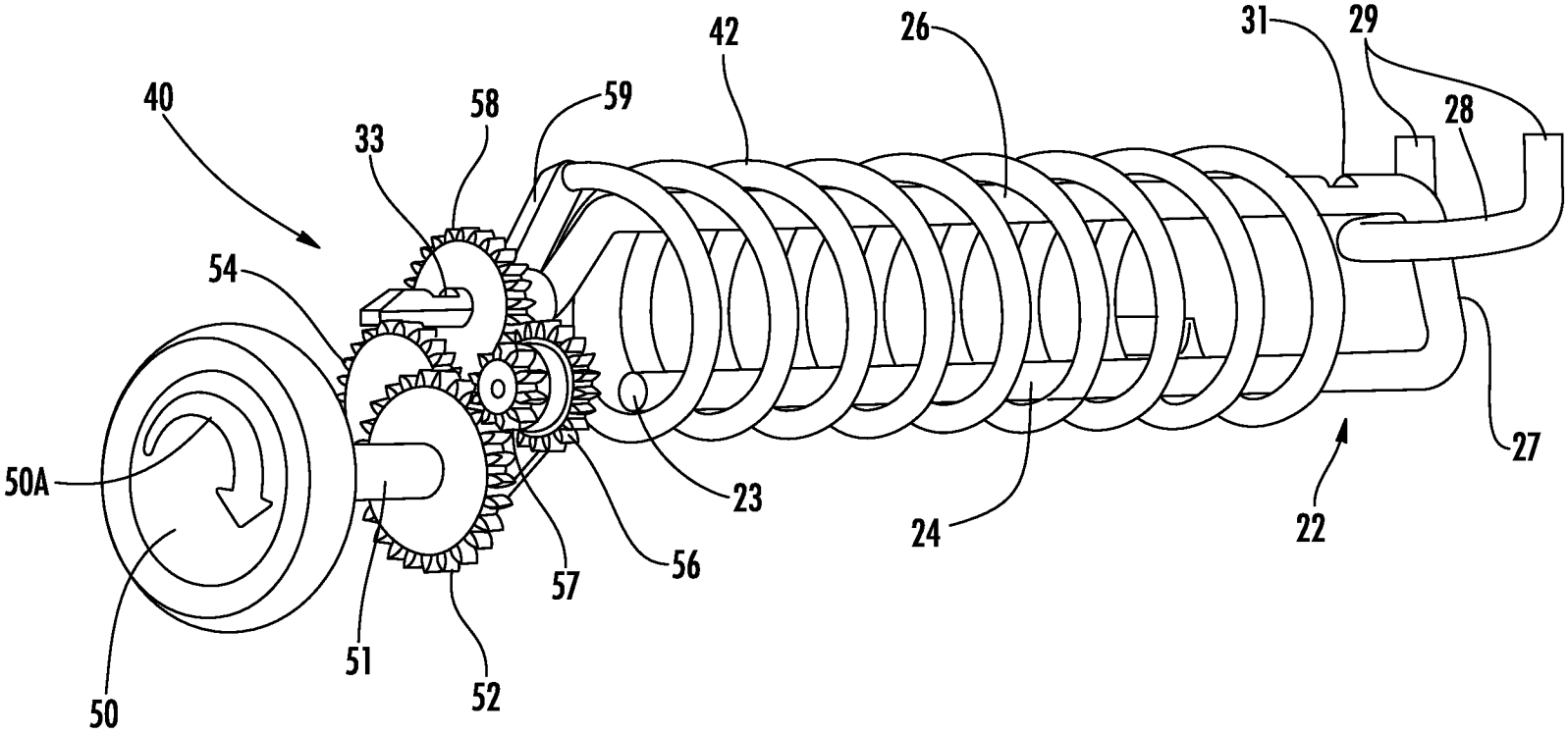
FIG. 3 is a right front perspective view of the merchandise display hook and time delay mechanism of FIG. 1 shown with the locking base, label holder and the housing of the time delay mechanism additionally removed for purposes of clarity.

FIG. 1 shows a peg hook 20 comprising a time delay mechanism 40 according to the invention with the peg hook configured for being mounted onto a pegboard 10. Display hook 20 further comprises a display arm 22 including a lower rod 24 and an upper rod 26. Lower rod 24 is commonly referred to as the "support rod" and as shown herein is typical of the support rod provided on conventional merchandise display hooks. The free end 23 (FIG. 3) adjacent the time delay mechanism 40 may be upturned slightly for retaining an item of merchandise on the lower rod against the influence of gravity. However, it is not essential that the free end 23 of the lower rod 24 be upturned since the time delay mechanism 40 serves to retain the items of merchandise on the lower rod 24, as will be described. In FIG. 3, the free end 23 of lower rod 24 is shown truncated without an upturned portion for purposes of clarity. As is best seen in FIG. 3, upper rod 26 is modified from the upper rod of a conventional merchandise display hook to cooperate with the time delay mechanism 40. Display arm 22 further comprises mounting structure 28 including at least one, and preferably more than one, mounting peg 29 for engaging a corresponding aperture 11 formed through the pegboard 10 to mount the display hook 20 to the pegboard in a known manner that extends outwardly from and is generally perpendicular to the plane of the pegboard. As shown, mounting structure 28 comprises a generally U-shaped cross bar having a mounting peg 29 at each end that is attached, for example by welding, to a connecting rod 27 that connects the lower rod 24 and the upper rod 26.

The merchandise display hook 20 may further comprise a locking base 30 for locking the display hook, and in particular, the display arm 22 to the display fixture. As shown herein, locking base 30 slides in a lengthwise direction along upper rod 26 above lower rod 24 between an unlocked position distant from mounting peg(s) 29 of the mounting structure 28 and a locked position proximate the mounting peg(s) in which the pegboard 10 is firmly sandwiched between the locking base and the mounting peg(s). In this position, the display arm 22 cannot be angled upwardly and the mounting peg(s) 29 retracted through the aperture(s) 11 in the pegboard 10 to thereby remove the display hook 20 from the pegboard. A recess 32 is provided in the locking base 30 for receiving a magnetic key (not shown) to unlock the locking base and thereby permit the display hook 20 to be removed from the display fixture in the manner previously described. A locking base and magnetic key suitable for use with the invention is described in greater detail in United States Patent Application Publication No. 2008/0169250, the disclosure of which is incorporated herein in its entirety, published on Jul. 17, 2008, and assigned to the assignee of the present invention. As best shown in FIG. 3, a transverse slot 31 is formed in the upper rod 26 for receiving a magnetic lock mechanism (not shown) disposed within the locking base 30 and operated by the magnetic key.

In operation, the display hook 20 including the time delay mechanism 40 is first mounted onto the display fixture. In the exemplary embodiment shown and described herein, the peg hook 20 is tilted upwardly and the mounting peg(s) 29 of the mounting structure 28 are inserted through corresponding apertures 11 formed through the pegboard 10. The peg hook 20 is then tilted downwardly until the display arm 22 is cantilevered outwardly from the pegboard in a generally horizontal orientation. The locking base 30, which was previously unlocked and positioned forward on upper rod 26 to allow the mounting peg(s) 28 to be inserted through the apertures 11 of the pegboard 10, is then slid rearward to the locked position abutting the pegboard such that the pegboard is firmly sandwiched (i.e. entrapped) between the locking base and the upturned mounting peg(s). A first item of merchandise 12 is then positioned onto the free end 23 of the lower (i.e. support) rod 24. The time delay mechanism 40 is next operated in a reverse direction, as will be described, to load the first item of merchandise 12 onto the support rod 24 of the display arm 22. As the first item of merchandise 12 is moved along support rod 24 by the time delay mechanism 40 in the direction of the pegboard 10, a second, or subsequent, item of merchandise 12 is positioned onto the free end 23 of the support rod in place of the previous item of merchandise. The process of positioning an item of merchandise 12 onto the support rod 24 is repeated until all of the items are suspended from the display hook 20 between the locking base 30 and the free end 23 of the support rod. In this manner, the time delay mechanism 40 is operable to rapidly load (i.e. "stock") a desired number of items of merchandise 12 onto the support rod 24 of the display hook 20. The items of merchandise 12 can be dispensed individually from the support rod 24 of the display arm 22 by operating the time delay mechanism 40 in a forward direction, as will be described. Importantly, the time delay mechanism 40 is configured to be operated in the reverse direction at a rate that is faster than the time delay mechanism can be operated in the forward direction. As a result, the items of merchandise 12 can be loaded onto the display hook 20 at a rate that is faster than the rate at which the items or merchandise 12 can be dispensed from the display hook.

Figure 2:
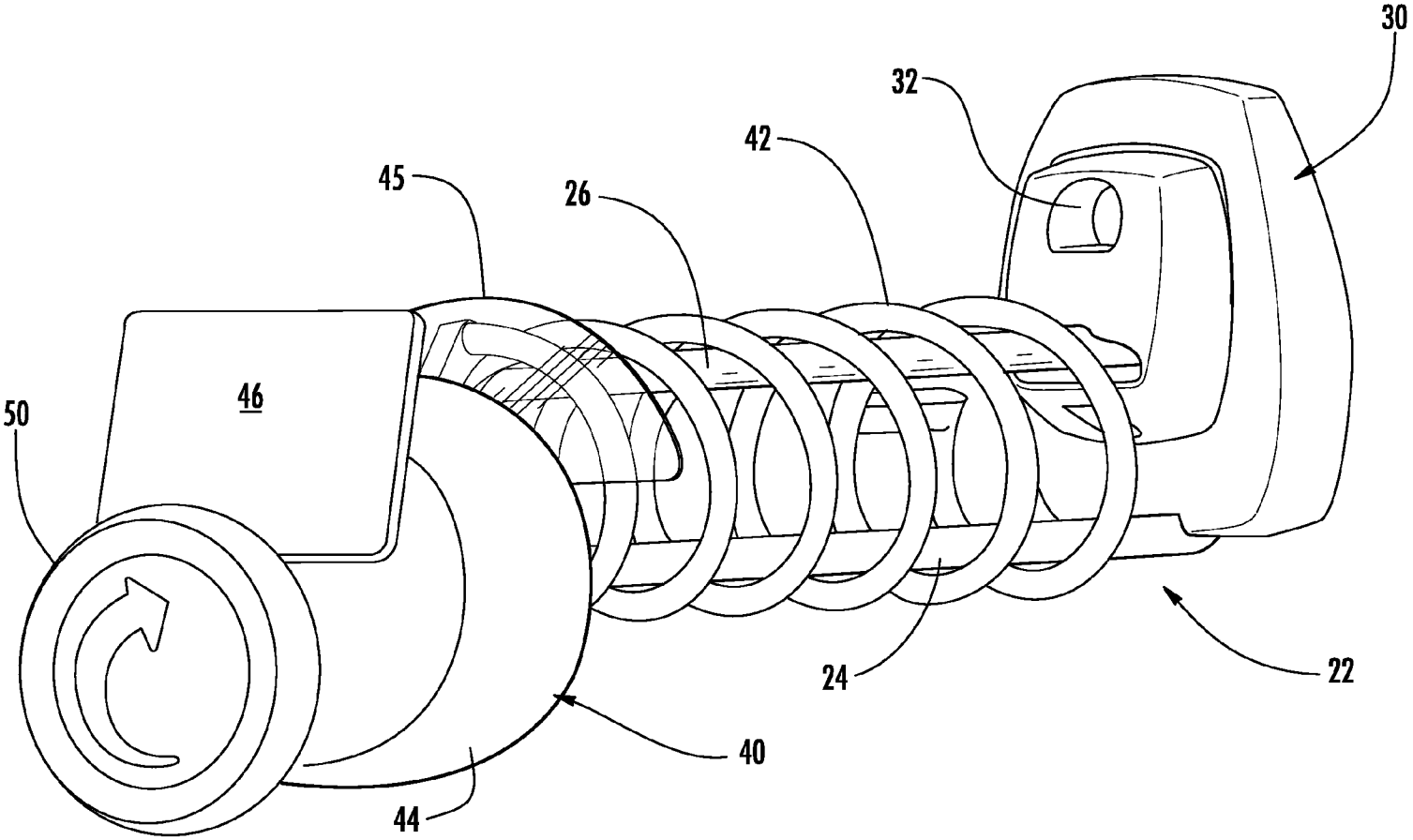
FIG. 2 is a right front perspective view of the merchandise display hook and the time delay mechanism of FIG. 1 shown with the items of merchandise and the pegboard type display fixture removed for purposes of clarity.

FIG. 2 illustrates the time delay mechanism 40 mounted on the display hook 20 with the items of merchandise 12 removed from the lower rod 24 for purposes of clarity. As shown, time delay mechanism 40 comprises a length of a helix 42 extending rearward from a housing 44 in the direction of the locking base 30. Housing 44 is preferably constructed in two portions removably secured together by one or more conventional fasteners, for example threaded screws. However, the components of the time delay mechanism 40 may be assembled and the portions of the housing 44 may then be permanently fused together, for example by heat sealing or ultrasonic welding, to prevent subsequent tampering by a shoplifter. If desired, housing 44 may be provided with a lock mechanism that engages a transverse slot 33 (FIG. 3) formed in the upper rod 26 to secure the time delay mechanism 40 on the display hook 20 in substantially the same manner as the lock mechanism of the locking base 30 engages transverse slot 31 on upper rod 26 to secure the locking base on the display hook. As previously mentioned, a magnetic key may be provided to unlock the lock mechanism so that the time delay mechanism 40 may be separated from the remainder of the display hook 20. An optional shield 45 may be provided adjacent a rear portion of the housing 44 for covering a forward portion of the helix 42. An optional label holder 46 may also be provided adjacent a front portion of the housing 44 for displaying information, such as price, related to the items of merchandise 12 supported on the display hook 20.

The time delay mechanism 40 further comprises a handle 50 extending in a forward direction and rotatably mounted on the housing 44. Handle 50 is operable for rotating the helix 42 relative to the lower rod 24 and the upper rod 26 of the display hook 20. The helix 42 is a conventional "coil spring" type helix having a substantially constant pitch. As used herein, the term "pitch" is intended to mean the axial distance between corresponding points on adjacent coils of the helix 42. However, a helix having a variable pitch may be used as desired to vary the distance an item of merchandise 12 is moved along the lower rod 24 of the display arm 22 in response to one full (i.e. 360 degrees) rotation of the helix. In the exemplary embodiment shown and described herein, the pitch of the helix 42 is sufficient to accommodate the thickness of the packaging for the item of merchandise 12, or a keeper containing the item of merchandise, while preventing a shoplifter from accessing the opening of the packaging or keeper that receives the lower rod 24 of the display arm 22. In this manner, a shoplifter is prevented from cutting the packaging or keeper on either side of the opening and forcibly removing the item of merchandise 12 from the lower rod 24 between adjacent coils of the helix 42.

FIG. 3 illustrates the time delay mechanism 40 with the housing 44, optional shield 45 and optional label holder 46 removed for purposes of clarity. As shown, the time delay mechanism 40 is mounted onto the display hook 20, and more particularly, onto the upper rod 26 of the display arm 22. Housing 44 defines an internal cavity or compartment for receiving certain internal components of the time delay mechanism 40. As best shown from the perspective view provided in FIG. 3, time delay mechanism 40 comprises an elongate drive shaft 51 rigidly attached at its forward end to handle 50 and at its rearward end to an outermost drive gear having a larger diameter portion 52 on its forward side and a smaller diameter portion 53 (FIGS. 4A and 4B; FIGS. 5A and 5B) on its rearward side. The larger diameter portion 52 of the outermost drive gear is provided with a plurality of gear teeth that engage, or mesh with, corresponding gear teeth on a smaller diameter portion 57 of an innermost drive gear. A larger diameter portion 56 of this innermost drive gear is provided with a plurality of gear teeth that in turn engage, or mesh with, corresponding gear teeth on a helix gear 58. The smaller diameter portion 53 of the outermost drive gear is provided with a plurality of gear teeth that alternatively engage, or mesh with, corresponding gear teeth on a larger diameter portion 54 of an intermediate drive gear. A smaller diameter portion 55 (FIG. 4B and FIG. 5B) of this intermediate drive gear is provided with a plurality of gear teeth that engage, or mesh with, the gear teeth of the helix gear 58. An extension arm 59 couples helix gear 58 to helix 42 such that rotation of helix gear 58 in turn rotates helix 42. Rotation of handle 50 in the direction indicated by arrow 50A (i.e. clockwise as viewed from the front of the display hook 20 looking in the direction of the display fixture) rotates the helix 42 in the same clockwise direction to dispense items of merchandise 12 from the lower rod 24 of the display arm 22 (see FIGS. 4A and 4B). Conversely, rotation of the handle 50 in the opposite (i.e. counter-clockwise) direction rotates the helix 42 in the same counter-clockwise direction to load items of merchandise 12 onto the lower rod 24 of the display arm 22 (see FIGS. 5A and 5B), as will be described.

The smaller diameter portion 53 of the outermost drive gear has a significantly smaller diameter than the larger diameter portion 54 of the intermediate drive gear, and the smaller diameter portion 55 of the intermediate drive gear has a significantly smaller diameter than the diameter of the helix gear 58. As a result, rotation of the handle 50 in the clockwise direction turns helix gear 58 (and consequently helix 42) at a rate that is slower than the rate at which the handle is turned. Accordingly, the rate at which helix 42 turns to dispense an item of merchandise 12 from lower rod 24 is proportional, but substantially slower than the rate at which the handle 50 is turned. As such, the intermediate drive gear comprising larger diameter portion 54 and smaller diameter portion 55 is also referred to herein as a "reducing gear" 54, 55. In a particular example, the reducing gear 54, 55 causes the helix 42 to turn at approximately one-sixth the rate at which the handle 50 is turned. In other words, six full turns (i.e. 360 degree revolutions) of the handle 50 are required to move the helix 42 through one full turn and thereby advance an item of merchandise 12 along the lower rod 24 a distance equal to the pitch of the helix. In this manner, a potential purchaser must rotate the handle 50 a total of six full turns (2160 degrees) to dispense from the end portion 23 of the lower rod 24 an item of merchandise that is suspended on the lower rod 24 of the display arm 22 between the two most forward adjacent coils of the helix 42. Accordingly, a shoplifter is further deterred from attempting to rapidly remove one or more items of merchandise 12 from the display hook 20. A 6:1 reducing ratio between the rate at which handle 50 is turned and the rate at which helix 42 turns to advance an item of merchandise along the lower rod 24 has been described herein merely for purposes of explanation. Those of ordinary skill in the art will readily recognize, understand and appreciate that any desired reducing ratio may be selected and the smaller diameter portion 53 of the outermost drive gear, the reducing gear 54, 55 and the helix gear 58 may be constructed in any suitable manner to produce the desired reduction rate between turns of handle 50 and corresponding turns of helix 42.

Figure 4A:
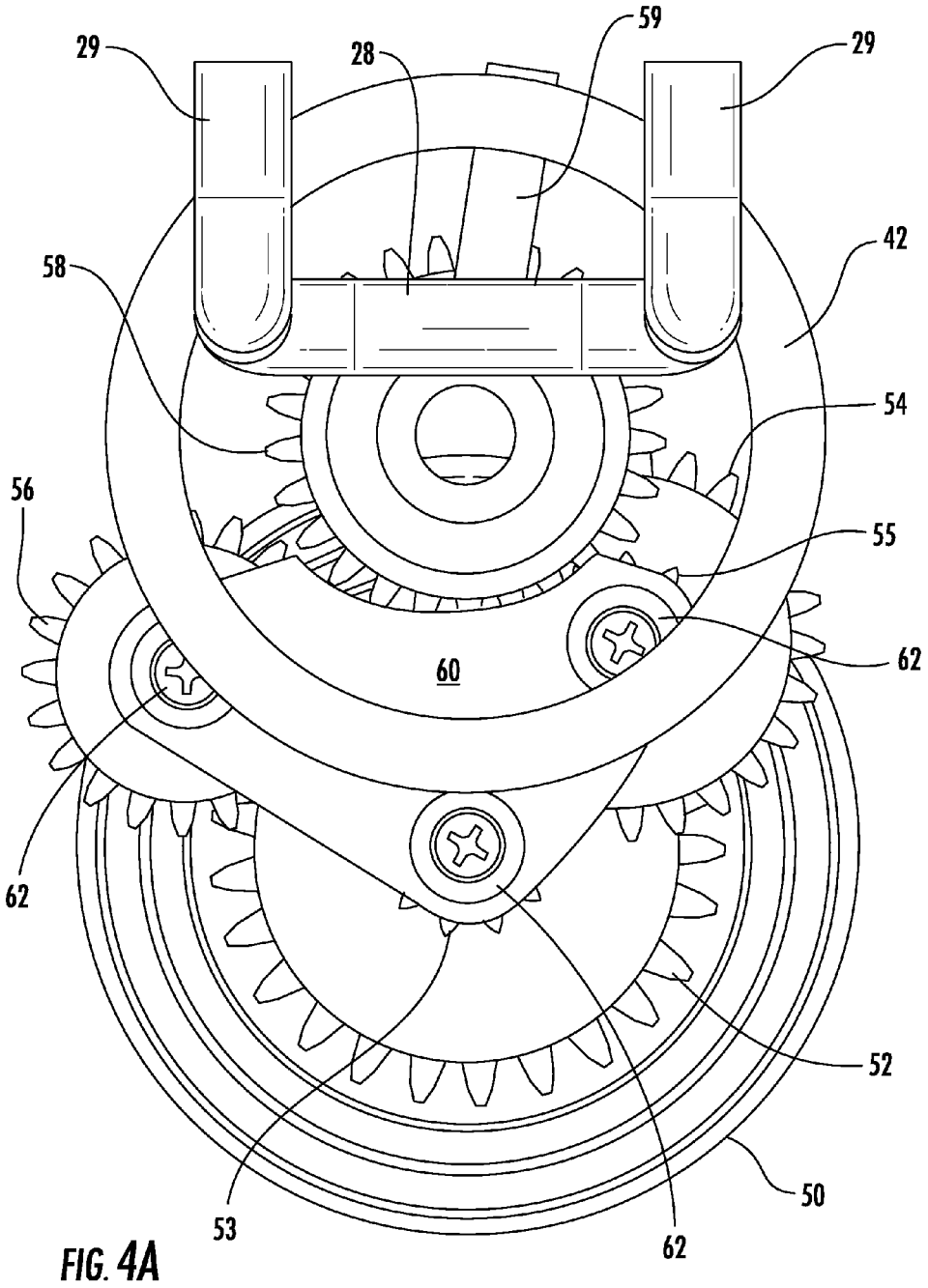
FIGS. 4A and 4B are each a rear view of a time delay mechanism for a merchandise display hook according to the invention illustrating a dispensing configuration for removing items of merchandise from the display hook.
Figure 4B:
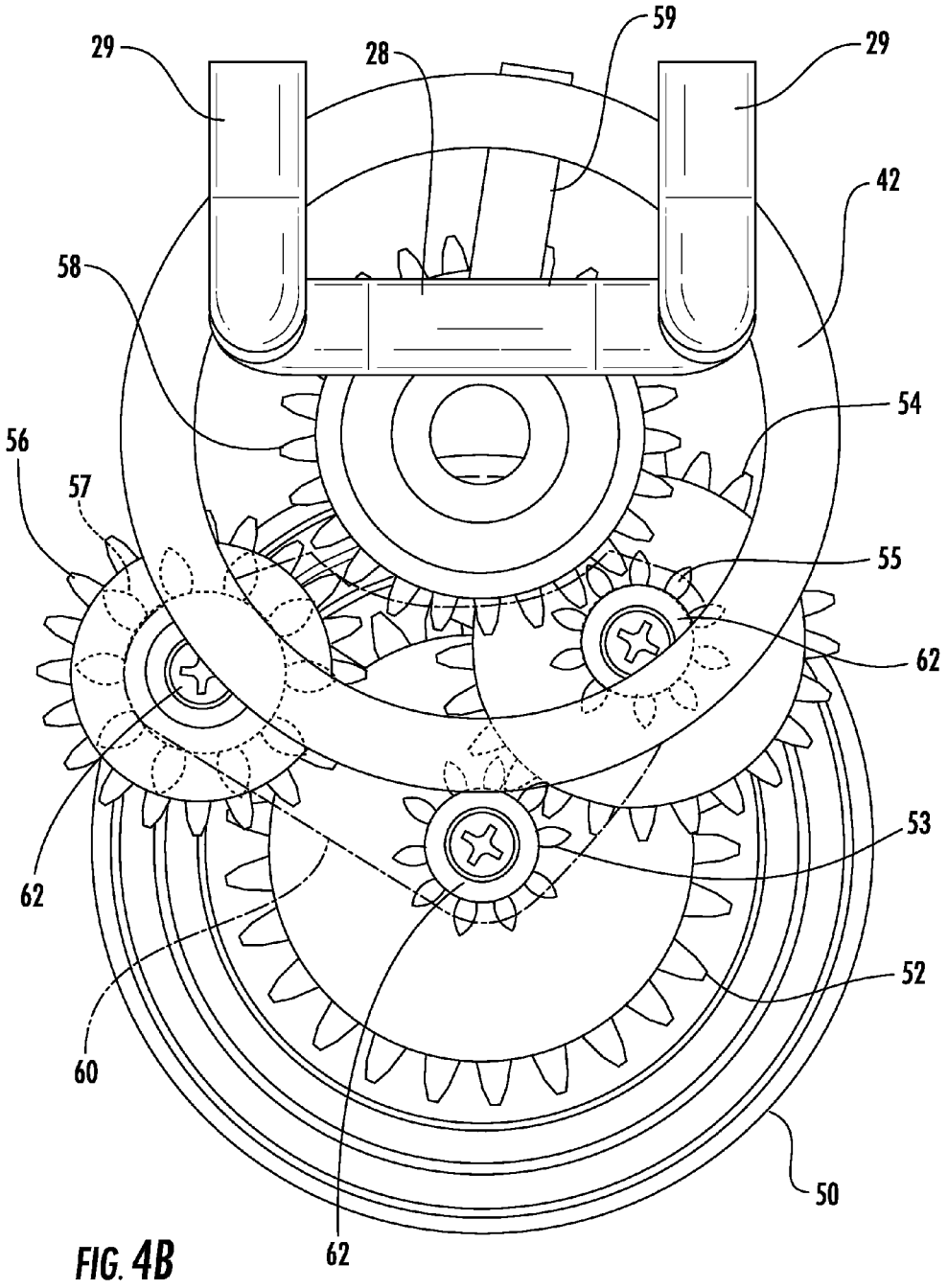
Figure 5A:
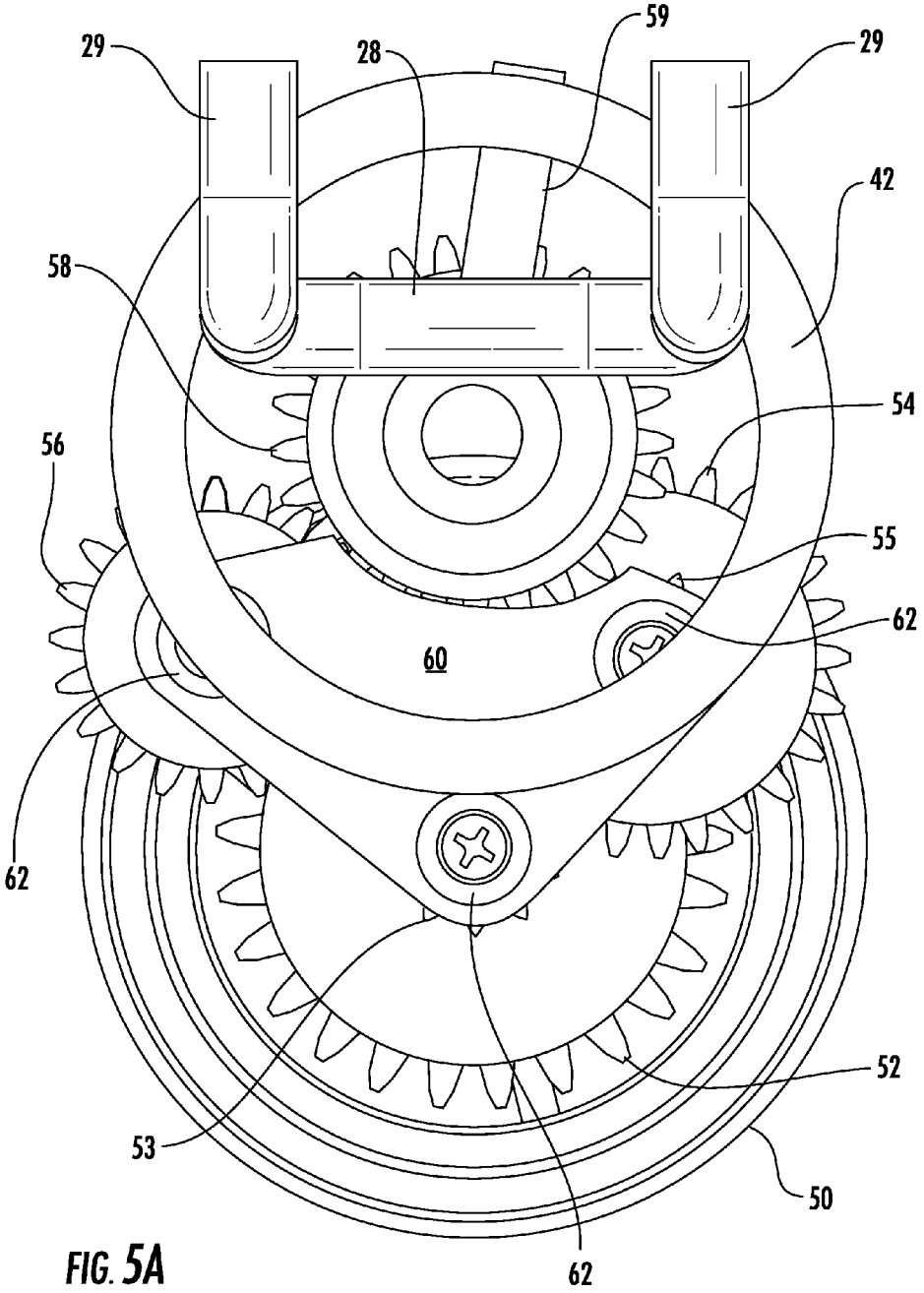
FIGS. 5A and 5B are each a rear view of a time delay mechanism for a merchandise display hook according to the invention illustrating a loading configuration for rapidly loading items of merchandise onto the display hook.
Figure 5B:
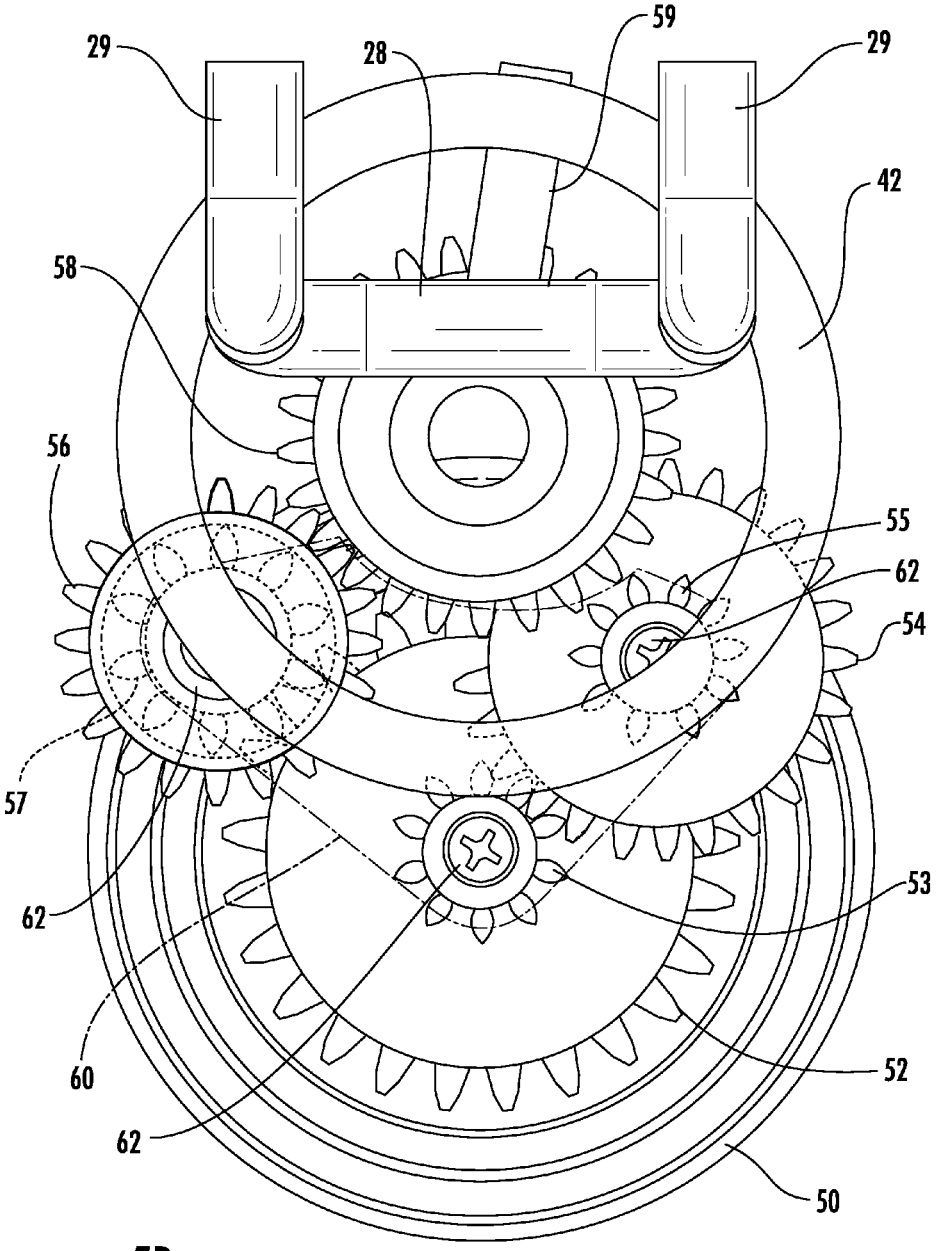

FIGS. 4A and 4B illustrate a time delay mechanism 40 for a display hook 20 according to the invention shown in a dispensing configuration for removing items of merchandise 12 from the lower rod 24 of the display hook. FIGS. 5A and 5B illustrate the same time delay mechanism 40 in a loading configuration for rapidly loading (stocking) items of merchandise 12 onto the lower (support) rod 24 of the display hook. FIGS. 4A and 4B and FIGS. 5A and 5B are each a rear view looking in the direction of the time delay mechanism 40 from the location of the display fixture 10. In these rear views, it can be seen that the time delay mechanism further comprises a relatively thin drive plate 60 that is attached to the rearward end of the drive shaft 51 that passes through the outermost drive gear having larger diameter portion 52 and smaller diameter portion 53. In FIG. 4B and FIG. 5B the outline of the drive plate 60 is shown in phantom line so that the smaller diameter portion 53 of the outermost drive gear and the smaller diameter portion 55 of the intermediate drive (reducing) gear are visible. Furthermore, the smaller diameter portion 57 of the innermost drive gear is shown in hidden lines. Drive plate 60 is also attached to the intermediate drive gear having larger diameter portion 54 and smaller diameter portion 55. Drive plate 60 is likewise attached to the innermost drive gear having larger diameter portion 56 and smaller diameter portion 57. Drive plate 60 may be attached to the drive shaft 51, intermediate drive (reducing) gear 54, 55 and innermost drive gear 56, 57 in any suitable manner, for example by fasteners 62 as shown. Thus, drive plate 60 couples drive shaft 51 to intermediate drive (reducing) gear 54, 55 and to innermost drive gear 56, 57, and as such, operates to alternatively engage helix gear 58 with intermediate drive (reducing) gear 54, 55 or with innermost drive gear 56, 57 depending on the direction of rotation of handle 50. In particular, drive plate 60 engages the smaller diameter portion 55 of the intermediate drive (reducing) gear with the helix gear 58 when the handle 50 is rotated in the clockwise direction indicated by arrow 50A in FIG. 3. Thus, the "dispensing" configuration wherein smaller diameter portion 53 meshes with larger diameter portion 54 and smaller diameter portion 55 meshes with helix gear 58 is illustrated by FIGS. 4A and 4B.

Conversely, drive plate 60 engages the larger diameter portion 56 of the innermost drive gear with the helix gear 58 when the handle 50 is rotated opposite to the direction indicated by arrow 50A in FIG. 3 (i.e. counter-clockwise). This "loading" or "stocking" configuration wherein larger diameter portion 52 meshes with smaller diameter portion 57 and larger diameter portion 56 meshes with helix gear 58 is illustrated by FIGS. 5A and 5B. Since the diameter of the larger diameter portion 52 of the outermost drive gear is substantially larger than the smaller diameter portion 57 of the innermost drive gear and the diameter of the larger diameter portion 56 of the innermost drive gear is approximately the same size or smaller than the diameter of the helix gear 58, helix 62 turns in the counter-clockwise direction at a rate that is faster than the rate at which handle 50 is turned. As a result, the items of merchandise 12 can be loaded (stocked) onto the lower (support) rod 24 of the display arm 22 of display hook 20 at a rate that is substantially faster than the items of merchandise can be dispensed from the display hook. By way of example, an item of merchandise 12 may be loaded (stocked) onto the lower (support) rod 24 in the loading (stocking) configuration at a rate in which one full counter-clockwise turn of the handle 50 results in one full counter-clockwise turn of the helix 42 and thereby moves an item of merchandise in the direction of the display fixture (i.e. rearward) a distance equal to the pitch of the helix. As previously described, utilizing the smaller diameter portion 53 of the outermost drive gear and the intermediate drive (reducing) gear 54, 55 in the dispensing configuration could then require six full clockwise turns of handle 50 to cause one full clockwise turn of the helix 42 and thereby dispense the item of merchandise 12.

The foregoing has described one or more exemplary embodiments of a merchandise display hook 20 for displaying items of merchandise on a display fixture 10 including a time delay mechanism 40 according to the invention. The time delay mechanism 40 is operable for increasing the amount of time required to remove an item of merchandise 12 from the display hook 20, while still permitting rapid loading (stocking) of the items of merchandise onto the display hook. Exemplary and preferred embodiments of a display hook 20 and time delay mechanism 40 have been shown and described herein for purposes of illustrating and enabling the best mode of the invention. Those of ordinary skill in the art, however, will readily understand and appreciate that numerous variations and modifications of the invention may be made without departing from the spirit and scope of the invention. Accordingly, all such variations and modifications are intended to be encompassed by the appended claims.

That which is claimed is:

1. A merchandise display hook comprising:

a support rod including mounting structure for mounting the display hook to a display fixture, the support rod having a first rear end adjacent the mounting structure and a second front end opposite the first rear end for loading items of merchandise onto the support rod and for dispensing the items of merchandise from the support rod;

a helix disposed about the support rod and extending along at least a lengthwise portion of the support rod;

a handle; and a time delay mechanism attached to the helix adjacent the second front end of the support rod, wherein a space is defined between the time delay mechanism and a portion of the second front end for loading and dispensing the items of merchandise, the time delay mechanism comprising a gear assembly operatively coupled to the handle, wherein, when in use, the handle rotates the helix in a first direction to load the items of merchandise onto the support rod and rotates the helix in a second opposite direction to dispense the items of merchandise from the support rod, wherein the time delay mechanism produces a ratio of a rate of rotation of the handle to a rate of rotation of the helix that is greater in the second direction to dispense the items of merchandise than in the first direction to load the items of merchandise such that the items of merchandise are loaded at a rate that is faster than the rate at which the items of merchandise are dispensed from the support rod.

2. The merchandise display hook of claim 1, wherein the handle is coupled to the gear assembly by a drive shaft that has a first end attached to the gear assembly and a second end attached to the handle.

3. The merchandise display hook of claim 1, wherein the gear assembly comprises an outermost drive gear, an intermediate drive gear, an innermost drive gear and a helix gear.

4. The merchandise display hook of claim 3, wherein the helix gear is configured to rotate the helix in a loading configuration at a rate that is substantially greater than the rate at which the helix gear rotates the helix in a dispensing configuration.

5. The merchandise display hook of claim 4, wherein the outermost drive gear has a larger diameter portion and a smaller diameter portion, the larger diameter portion of the outermost drive gear being configured to engage a smaller diameter portion of the innermost drive gear and the smaller diameter portion of the outermost drive gear being configured to engage a larger diameter portion of the intermediate drive gear.

6. The merchandise display hook of claim 5, wherein the innermost drive gear further has a larger diameter portion that is configured to engage the helix gear and the intermediate drive gear further has a smaller diameter portion that is configured to engage the helix gear.

7. The merchandise display hook of claim 6, wherein the smaller diameter portion of the outermost drive gear engages the larger diameter portion of the intermediate drive gear and the smaller diameter portion of the intermediate drive gear engages the helix gear in a dispensing configuration.

8. The merchandise display hook of claim 6, wherein the larger diameter portion of the outermost drive gear engages the smaller diameter portion of the innermost drive gear and the larger diameter portion of the innermost drive gear engages the helix gear in a loading configuration.

9. The merchandise display hook of claim 1, wherein the ratio of the rate of rotation of the handle to the rate of rotation of the helix to dispense the items of merchandise from the support rod is 6:1.

10. The merchandise display hook of claim 1, wherein the ratio of the rate of rotation of the handle to the rate of rotation of the helix to load the items of merchandise onto the support rod is 1:1.

11. The merchandise display hook of claim 1, wherein the gear assembly comprises:

an outermost drive gear having a larger diameter portion and a smaller diameter portion;

an intermediate drive gear having a smaller diameter portion and a larger diameter portion;

an innermost drive gear having a larger diameter portion and a smaller diameter portion; and a helix gear;

wherein the larger diameter portion of the outermost drive gear is configured to engage the smaller diameter portion of the innermost drive gear and the smaller diameter portion of the outermost drive is configured to engage the larger diameter portion of the intermediate drive gear.

12. The merchandise display hook of claim 11, wherein the smaller diameter portion of the intermediate drive gear engages the helix gear in a dispensing configuration and wherein the larger diameter portion of the innermost drive gear engages the helix gear in a loading configuration.

13. The merchandise display hook of claim 12, further comprising a drive shaft having a first end attached to the outermost drive gear of the gear assembly and a second end attached to the handle.

14. The merchandise display hook of claim 13, further comprising a drive plate that is attached to the first end of the drive shaft, the intermediate drive gear, and the innermost drive gear.

15. The merchandise display hook of claim 14, wherein the drive plate is alternatively movable between the dispensing configuration when the handle is rotated in the first direction and the loading configuration when the handle is rotated in the opposite second direction.

16. A method of dispensing an item of merchandise from a merchandise display hook and for loading items of merchandise onto the display hook, comprising:

providing a merchandise display hook further comprising a support rod including mounting structure for mounting the display hook to a display fixture, the support rod having a first rear end adjacent the mounting structure and a second front end opposite the first rear end for loading items of merchandise onto the support rod and for dispensing the items of merchandise from the support rod;

providing a helix disposed about the support rod and extending along at least a lengthwise portion of the support rod; and providing a time delay mechanism operatively coupled to the helix adjacent the second front end of the support rod, wherein a space is defined between the time delay mechanism and a portion of the second front end for loading and dispensing the items of merchandise, the time delay mechanism including a gear assembly operatively coupled to a handle, wherein, when in use, the handle rotates the helix in a first direction to load the items of merchandise onto the support rod and rotates the helix in an opposite second direction to dispense the items of merchandise onto from the support rod, wherein the time delay mechanism produces a ratio of a rate of rotation of the handle to a rate of rotation of the helix that is greater in the second direction to dispense the items of merchandise than in the first direction to load the items of merchandise such that the items of merchandise are loaded at a rate that is faster than the rate at which the items of merchandise are dispensed from the support rod.

17. A merchandise display hook comprising:

a support rod including mounting structure for mounting the display hook to a display fixture, the support rod having a first rear end adjacent the mounting structure and a second front end opposite the first rear end for loading items of merchandise onto the support rod and for dispensing the items of merchandise from the support rod;

a helix disposed about the support rod and extending along at least a lengthwise portion of the support rod;

a handle; and a time delay mechanism attached to the helix adjacent the second front end of the support rod, wherein a space is defined between the time delay mechanism and a portion of the second front end for loading and dispensing the items of merchandise, the time delay mechanism comprising a gear assembly operatively coupled to the handle, the gear assembly comprising a drive gear, a reducing gear, and a helix gear, the drive gear having a larger diameter than the reducing gear, the helix gear operably engaged with the helix, wherein the helix gear is configured to selectively engage the drive gear and the reducing gear in response to rotation of the handle, and wherein rotation of the handle in a first direction causes the helix gear to engage the drive gear to rotate the helix in the first direction in order to load items of merchandise onto the support rod, and wherein rotation of the handle in a second direction causes the helix gear to engage the reducing gear to rotate the helix in the second direction in order to dispense items of merchandise such that items of merchandise are loaded onto the support rod at a rate that is faster than the rate at which the items of merchandise are dispensed from the support rod.

* * * * *